US010823485B2

(12) United States Patent
Lv et al.

(10) Patent No.: US 10,823,485 B2
(45) Date of Patent: Nov. 3, 2020

(54) REFRIGERATOR

(71) Applicant: BSH HAUSGERAETE GMBH, Munich (DE)

(72) Inventors: Ping Lv, Nanjing (CN); Chuan Zhang, Chuzhou (CN); Yaoguo Xu, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 99 days.

(21) Appl. No.: 15/856,291

(22) Filed: Dec. 28, 2017

(65) Prior Publication Data

US 2018/0187950 A1 Jul. 5, 2018

(30) Foreign Application Priority Data

Dec. 29, 2016 (CN) ..... 2016 1 1254116

(51) Int. Cl.

| | |
|---|---|
| ***F25D 23/00*** | (2006.01) |
| ***F25D 23/02*** | (2006.01) |
| ***A47B 95/02*** | (2006.01) |
| ***A47B 95/04*** | (2006.01) |
| ***F25D 23/04*** | (2006.01) |

(52) U.S. Cl.

CPC ..... *F25D 23/025* (2013.01); *A47B 95/02* (2013.01); *A47B 95/043* (2013.01); *F25D 23/02* (2013.01); *F25D 23/04* (2013.01); *A47B 2095/027* (2013.01); *F25D 2201/1262* (2013.01); *F25D 2323/023* (2013.01); *F25D 2400/18* (2013.01)

(58) Field of Classification Search

CPC ..... F25D 23/00; F25D 23/02; F25D 23/026; F25D 23/028; F25D 23/025; F25D 23/04; F25D 2400/18; F25D 2323/023; F25D 2201/1262; A47F 3/0434; E05D 11/0054

USPC ..... 312/401, 405, 116, 138.1, 326–329, 312/405.1, 321.5

See application file for complete search history.

(56) References Cited

U.S. PATENT DOCUMENTS 4,108,519 A * 8/1978 Chervenak ..... A47B 95/02 16/425
5,214,877 A * 6/1993 Kaspar ..... A47F 3/043 312/296
5,910,083 A * 6/1999 Richardson ..... E06B 3/66366 312/116

(Continued)

FOREIGN PATENT DOCUMENTS

CN 204535247 * 8/2015
EP 3343151 * 7/2018

(Continued)

*Primary Examiner* — Janet M Wilkens
(74) *Attorney, Agent, or Firm* — Laurence A. Greenberg; Werner H. Stemer; Ralph E. Locher

(57) ABSTRACT

A refrigerator includes a case body, an outer door, and an inner door disposed in front of the outer door. The outer door has a front door panel that forms a facade of the outer door. The front door panel includes a cover portion, and the cover portion projects, along a length or width direction, out of a heat-insulation portion that is of the outer door and that is configured to seal the opening. The outer door further includes a protecting plate, connected to a rear surface of the cover portion and faces the inner door. The refrigerator is provided with a good appearance on the premise that good cooperation between the inner door and the outer door is ensured.

14 Claims, 3 Drawing Sheets

(56) References Cited

U.S. PATENT DOCUMENTS

| | | | | | |
|---|---|---|---|---|---|
| 6,052,965 | A * | 4/2000 | Florentin | A47F 3/0434 | 52/786.13 |
| 6,088,966 | A * | 7/2000 | Kenkel | E05D 11/0054 | 49/383 |
| 6,435,630 | B1 * | 8/2002 | Anin | A47F 3/0434 | 312/116 |
| 2002/0056184 | A1 * | 5/2002 | Richardson | A47F 3/0434 | 29/458 |
| 2009/0007587 | A1 * | 1/2009 | Lanzl | A47F 3/0434 | 62/449 |
| 2009/0045712 | A1 * | 2/2009 | Laible | A47B 96/20 | 312/401 |
| 2010/0283359 | A1 * | 11/2010 | Hottmann | A47B 96/00 | 312/204 |
| 2018/0146797 | A1 * | 5/2018 | Artwohl | E06B 7/28 | |
| 2018/0164024 | A1 * | 6/2018 | Lv | F25D 23/028 | |
| 2018/0216873 | A1 * | 8/2018 | Jung | F25D 19/006 | |

FOREIGN PATENT DOCUMENTS

| | | | |
|---|---|---|---|
| EP | 3378359 | * | 9/2018 |
| WO | 2004105558 | * | 12/2004 |
| WO | 2004106823 | * | 12/2004 |

* cited by examiner

REFRIGERATOR

CROSS-REFERENCE TO RELATED APPLICATION

This application claims the benefit, under 35 U.S.C. § 119, of Chinese patent application CN 201611254116.3, filed Dec. 29, 2016; the prior application is herewith incorporated by reference in its entirety.

BACKGROUND OF THE INVENTION

Technical Field

The present invention relates to a refrigerator.

Storage space of a refrigerator may be sealed by using a single door, and may also be sealed by using a dual door including an inner door and an outer door. The dual door includes the inner door connected to a case body, and the outer door connected to the inner door. Structures of the inner door and the outer door may directly affect a cooperative relationship between the inner door and the outer door, and an appearance of the refrigerator.

BRIEF SUMMARY OF THE INVENTION

The present invention provides an improved refrigerator, to resolve at least one of the foregoing technical problems.

With the foregoing and other objects in view there is provided, in accordance with the invention, a refrigerator, comprising:

a case body having a storage compartment, an outer door rotatably disposed in front of said case body, and an inner door formed with an opening, and said outer door being located in front of said inner door for opening and closing said opening; and said outer door having a front door panel forming a facade of said outer door and having a heat-insulation portion, said front door panel having a cover portion projecting, along a length or width direction, beyond said heat-insulation portion and being configured to seal said opening; and said outer door further having a protecting plate connected to a rear surface of said cover portion and disposed to face said inner door.

To resolve the foregoing problem, the present invention provides a refrigerator, including a case body having a storage compartment, an outer door rotatably disposed in front of the case body, and an inner door, where the inner door has an opening, and the outer door is located in front of the inner door to open or close the opening; the outer door includes a front door panel that forms a facade of the outer door, the front door panel includes a cover portion, and the cover portion extends, along a length or width direction, out of a heat-insulation portion that is of the outer door and that is configured to seal the opening; the outer door further includes a protecting plate, and the protecting plate is connected to a rear surface of the cover portion and faces the inner door.

Compared with the prior art, the solution has the following advantages: Strength of the cover portion extending out of the heat-insulation portion in the front door panel is relatively weak. The protecting plate is connected to the rear surface of the cover portion. On one hand, the strength of the cover portion can be improved, and on the other hand, a covering function can be achieved, thereby preventing a backside of the cover portion from being polluted when the backside of the cover portion is directly touched by a user.

In particular, when the front door panel uses a glass plate, it is beneficial to preventing a rear surface of the glass plate from being touched by the user, and when a backside of the glass plate has a printing layer, it is particularly advantageous according to the solution of the present invention.

In some embodiments, the protecting plate may be adhered to the rear surface of the cover portion.

In some other embodiments, the heat-insulation portion may further include a doorframe, and the protecting plate may further be fixed to the doorframe to prevent the protecting plate from moving relative to the cover portion.

In accordance with an added feature of the invention, one side of the protecting plate towards the doorframe may be provided with a positioning structure in cooperation with the doorframe. The positioning structure is configured to fix a relative position between the protecting plate and the doorframe, thereby preventing the protecting plate from deforming along a length direction thereof.

In some embodiments, the positioning structure may include positioning slots located at two ends of the protecting plate in a length direction, and the positioning slots are clamped with corners located at ends of the doorframe in the length direction. The protecting plate is a plate member, the positioning slots may be formed by pressing, and molding is convenient. In addition, the positioning slots are clamped with the corners of the doorframe directly, and no structure matching the positioning structure needs to be additionally disposed on the doorframe, thereby simplifying design and manufacturing processes.

In accordance with an additional feature of the invention, the protecting plate may include a fixing edge sandwiched between the front door panel and the doorframe.

In some embodiments, the protecting plate may include a first flange that extends towards the back of the door, and a surface of the doorframe towards the front of the door is provided with a recess for accommodating the first flange. The recess is provided in the doorframe that is provided in the doorframe. During actual mounting, the first flange is inserted into the corresponding recess in the doorframe first to fix the relative position between the protecting plate and the doorframe, then a cover of the front door panel is provided on front surfaces of the doorframe and the protecting plate, and the protecting plate is adhered to the front door panel.

In accordance with another feature of the invention, the protecting plate includes a free end away from the heat-insulation portion, and the free end may exceed out of a side of the cover portion away from the heat-insulation portion.

In some embodiments, the protecting plate includes a free end away from the heat-insulation portion, and the free end may include a second flange bent towards the back of the door.

In accordance with a further feature of the invention, the second flange extends out of an edge on a side of the cover portion away from the heat-insulation portion, to beautify a boundary curve of the outer door on a handle side.

The second flange may be in the shape of a sloping surface and slopes along a direction away from the heat-insulation portion. Alternatively, the second flange may be perpendicular to the cover portion.

In accordance with yet an added feature of the invention, the protecting plate may extend from one end to the other end of the cover portion along a length direction of the cover portion. For example, the protecting plate may completely cover the rear surface of the cover portion.

In accordance with yet an additional feature of the invention, the protecting plate may be a plastic plate.

In accordance with yet another feature of the invention, the inner door may include a handle portion that protrudes forward and that is located at the back of the cover portion, and the protecting plate is located between the cover portion and the handle portion. In a front-and-rear direction, the cover portion may be configured to cover at least a part of the handle portion.

In some embodiments, there may be a gap between the handle portion and the protecting plate in the front-and-rear direction.

In accordance with yet a further feature of the invention, the heat-insulation portion may further include a heat-insulation glass module and a doorframe disposed around the heat-insulation glass module, and the front door panel is connected to a front side of the doorframe.

In accordance with a concomitant feature of the invention, the doorframe includes several borders that extend along the length direction and the width direction, and the borders are extruding members.

Other features which are considered as characteristic for the invention are set forth in the appended claims.

Although the invention is illustrated and described herein as embodied in a refrigerator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION

Figure 1:
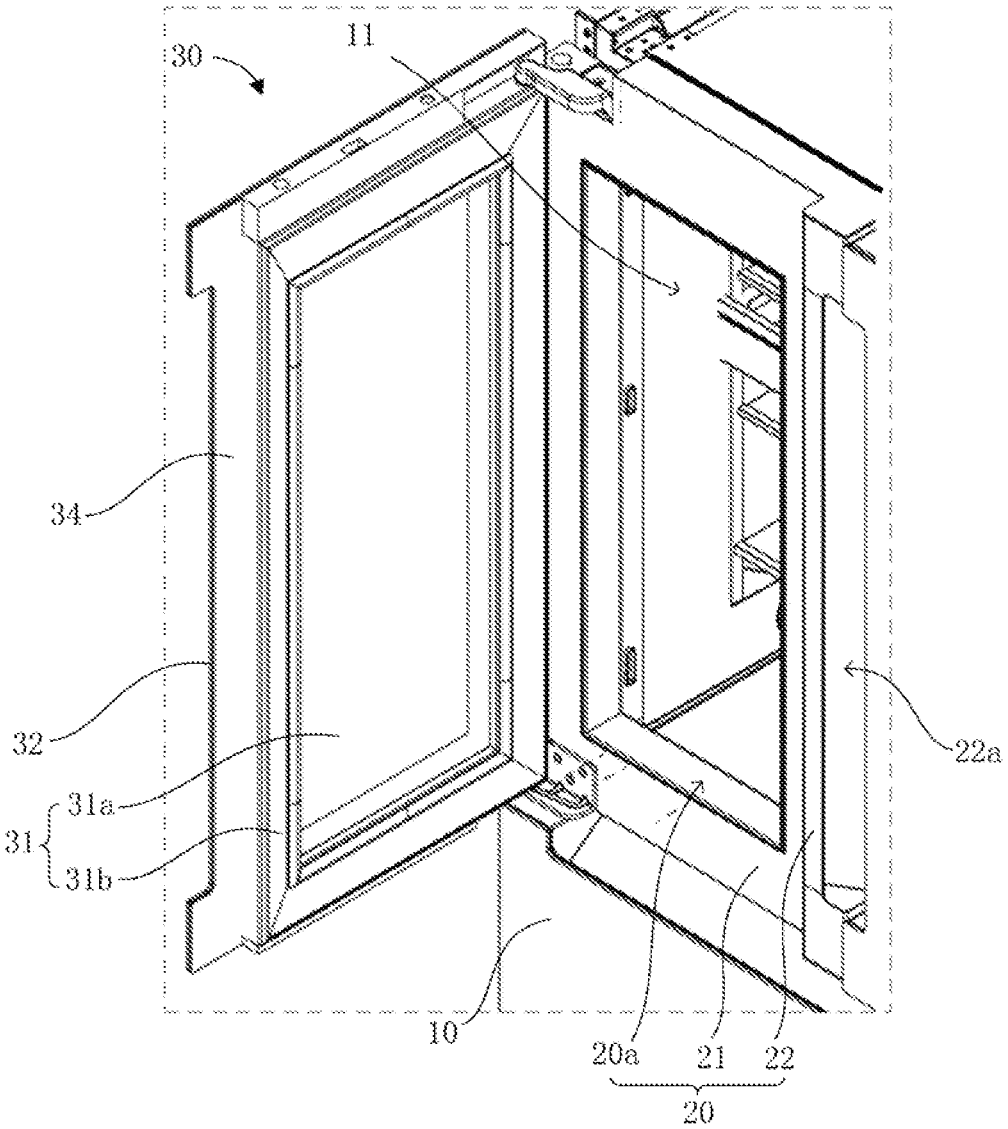
FIG. 1 is a schematic partial three-dimensional diagram of a refrigerator in positions of an inner door and an outer door according to an embodiment of the present invention.
Figure 2:
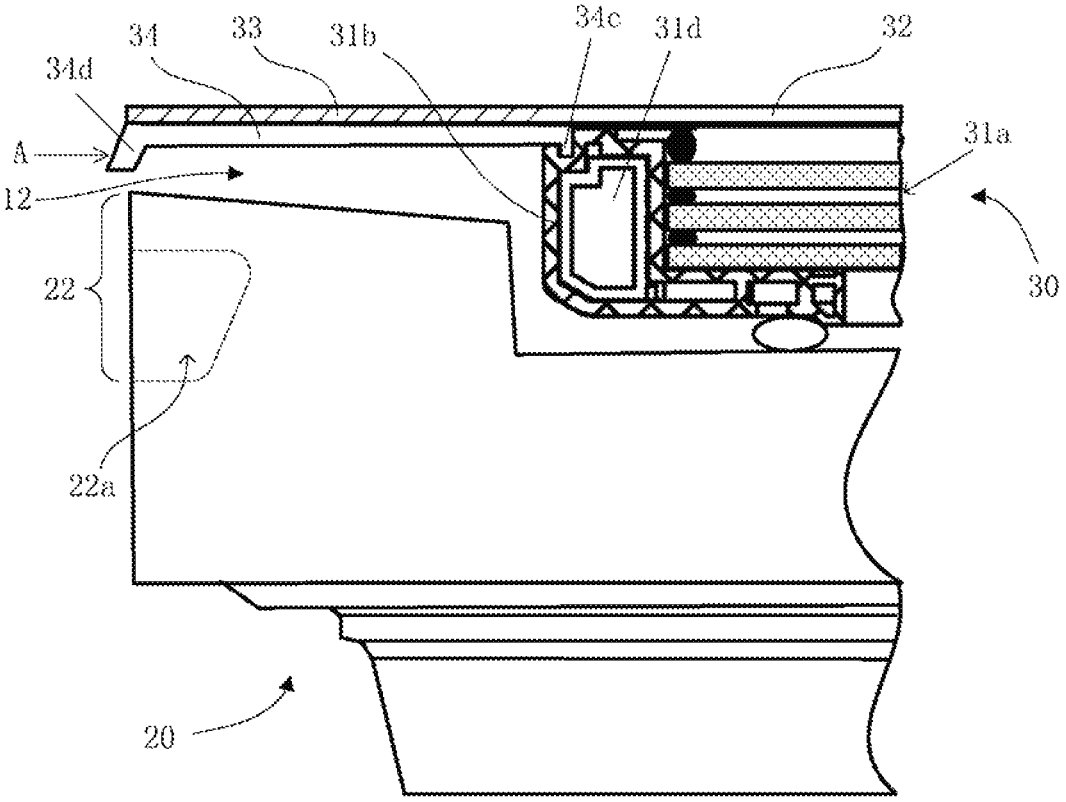
FIG. 2 is a schematic structural diagram of an inner door and an outer door of a refrigerator in a stacked condition according to an embodiment of the present invention.

Referring now to the figures of the drawing in detail and first, particularly, to FIGS. 1 and 2 thereof, there is shown a refrigerator. The refrigerator includes a case body 10 having a storage compartment 11, an inner door 20 rotatably disposed (i.e., articulated, pivotal) in front of the case body 10, and an outer door 30, where the outer door 30 is rotatably disposed (i.e., articulated, pivotal) in front of the inner door 20.

Storage space may be provided in the inner door 20 to store an item, the storage space thereof has an opening 20*a* towards the outer door 30, and the outer door 30 is configured to open or close the opening 20*a*.

In the present invention, the term "front" and "back" respectively represent a front portion and a rear portion along a front-and-rear direction of the door.

The outer door 30 has a heat-insulation portion 31 configured to seal the opening 20*a*, to prevent the storage compartment 11 from exchanging with external heat through the opening 20*a*. The outer door 30 includes a front door panel 32, the front door panel 32 includes a cover portion 33 extending out of the heat-insulation portion 31 along a width direction of the outer door 30, to form allowance space 12 at the back of the cover portion 33.

The inner door 20 may include a protruding portion 22 extending into the allowance space 12. The protruding portion 22 may include a handle portion 22*a* configured to open the outer door 30. At least a part of the handle portion 22*a* is covered by the cover portion 33. From the perspective of a form, the handle portion 22*a* may use a form of a handle recess or a handle, and a handle recess is used in this embodiment.

In an embodiment, the front door panel 32 may be a component of the heat-insulation portion 31. In another embodiment, the front door panel 32 is not a component of the heat-insulation portion 31, for example, the front door panel 32 is only configured to decorate the outer door 30.

As shown in FIG. 2, the heat-insulation portion 31 may include a heat-insulation glass module 31*a* and a doorframe 31*b* disposed around the heat-insulation glass module 31*a*, and the front door panel 32 is disposed in front of the doorframe 31*b*. A heat-insulation cavity 31*d* is provided in the doorframe 31*b*. The heat-insulation cavity 31*d* may be filled with foamed materials or be closed heat-insulation space.

In this embodiment, heat-insulation space is formed between the front door panel 32 and the heat-insulation glass module 31*a*. In some other embodiments, the front door panel 32 together with at least one glass plate located behind the front door panel 32 may form the heat-insulation glass module 31*a*. In these embodiments, the front door panel 32 is a component of the heat-insulation portion 31.

In this embodiment, the cover portion 33 is located on a longitudinal side of the outer door 30, the front door panel 32 exceeds out of the doorframe 31*b* of the heat-insulation portion 31 along the width direction of the outer door 30 to form the cover portion 33. It is easy to understand that in an alternative embodiment, when the cover portion 33 is located on a transversal side of the outer door 30, the front door panel 32 exceeds out of the doorframe 31*b* of the heat-insulation portion 31 along a height direction of the outer door 30 to form the cover portion 33.

In this embodiment, the cover portion 33 is an integral part of the front door panel 32. In an alternative embodiment, the cover portion 33 may be a part that is manufactured separately to be assembled in a main part of the front door panel 32.

The doorframe 31*b* may include several borders (not shown) that extend along the length direction and the width direction, and the borders may be formed by processes such as an extrusion process and an injection molding process. In this embodiment, the borders are extruding members.

The inner door 20 includes a door body 21 surrounding the opening 20*a*, and the door body 21 may be filled with foamed heat-insulation materials.

The outer door 30 includes a protecting plate 34, and the protecting plate 34 is connected to a rear side of the cover portion 33 and faces the inner door 20. From the perspective of a connection manner, the protecting plate 34 may be attached to the rear surface of the cover portion 33 by means of adhesion or other manners. From the perspective of materials, the protecting plate 34 may be a plastic plate.

It can be seen from FIG. 2 that, along the front-and-rear direction of the door, the protecting plate 34 is located between the cover portion 33 and the handle portion 22*a* of the inner door 20. There is a gap between the handle portion 22*a* and the protecting plate 34 in the front-and-rear direction.

The solution has the following advantages: Strength of the cover portion 33 extending out of the doorframe 31*b* in the front door panel 32 is relatively weak. The protecting plate 34 is connected to the back of the cover portion 33. On one hand, the strength of the cover portion 33 can be improved, and on the other hand, a protection function can be achieved, thereby preventing a backside of the cover portion 33 from being polluted when the backside of the cover portion 33 is directly touched by a user. In particular, when the front door panel 32 uses a glass plate, the protecting plate 34 is beneficial to preventing a backside of the front door panel 32 from being exposed in an environment that may be touched by the user, thereby preventing the backside of the front door panel from being maintained a fingerprint and/or preventing the user from directly touching an ink printing layer on the backside of the front door panel.

In addition, when the handle portion 22*a* on the inner door 20 protrudes towards the front, the width of the doorframe 31*b* of the outer door 30 on one side of the handle portion 22*a* of the inner door 20 may be reduced to avoid the handle portion 22*a* of the inner door 20. In this case, the cover portion 33 is disposed to make the handle portion 22*a* extend into the allowance space at the back of the cover portion 33. On one hand, the handle portion of the inner door can be covered by the cover portion 33, and an appearance is more aesthetical; on the other hand, each border in the doorframe of the outer door can be maintained to be capable of molding by completely using the extrusion process.

There is a gap between the handle portion 22*a* of the inner door 20 and the protecting plate 34 in the front-and-rear direction, to prevent space set aside for movement of the handle portion 22*a*.

To effectively protect the backside of the front door panel 32, the protecting plate 34 extends from one end to the other end of the cover portion 33 along a length direction of the cover portion 33, that is, the sizes of the cover portion 33 and the protecting plate 34 are basically the same along the length direction. Preferably, the shape and the size of a part of the protecting plate 34 that is adhered to the cover portion 33 are basically the same as those of the front door panel 32 of the outer door 30, to completely cover the rear surface of the cover portion 33.

To improve strength, the protecting plate 34 is fixed to the doorframe 31*b*, so that when the user applies force to the protecting plate 34, the force may not completely act on the cover portion 33 and is shared by the doorframe 31*b*.

Figure 3:
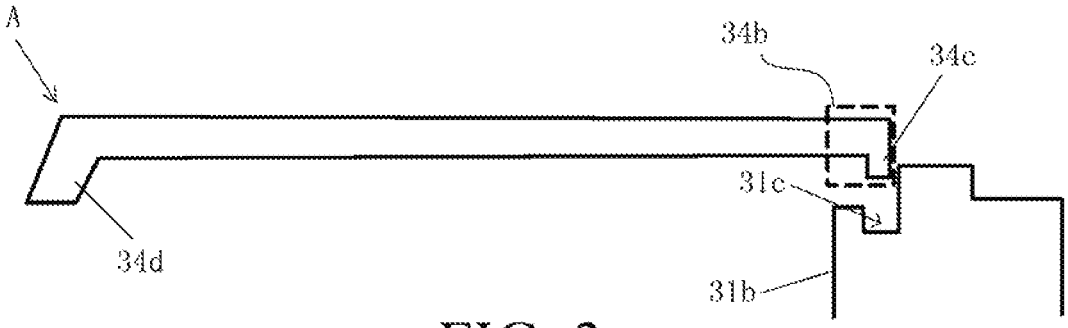
FIG. 3 is a schematic exploded view of a protecting plate and a doorframe of an outer door of a refrigerator according to an embodiment of the present invention.

Referring to FIG. 3, the protecting plate 34 includes a fixing edge 34*b* (outlined in dashed lines in FIG. 3) fixed to the doorframe 31*b*, and a free end A away from the doorframe 31*b* and the heat-insulation portion 31. The fixing edge 34*b* may be sandwiched between the front door panel 32 and the doorframe 31*b*. This is beneficial to not only improving the strength of the protecting plate 34, but also close attachment between the cover portion 33 and the protecting plate 34.

In this embodiment, one side of the fixing edge 34*b* towards the doorframe 31*b* is provided with a first flange 34*c* that extends towards the back of the door, and a surface of the doorframe 31*b* towards the front of the door is provided with a recess 31*c* for accommodating the first flange 34*c*.

Figure 4:
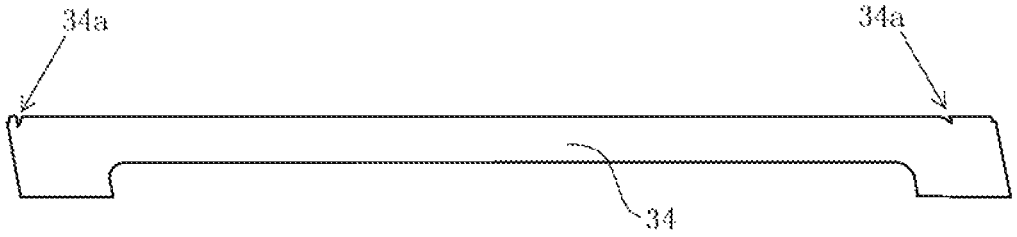
FIG. 4 is a schematic three-dimensional structural diagram of a protecting plate of a refrigerator according to an embodiment of the present invention.
Figure 5:
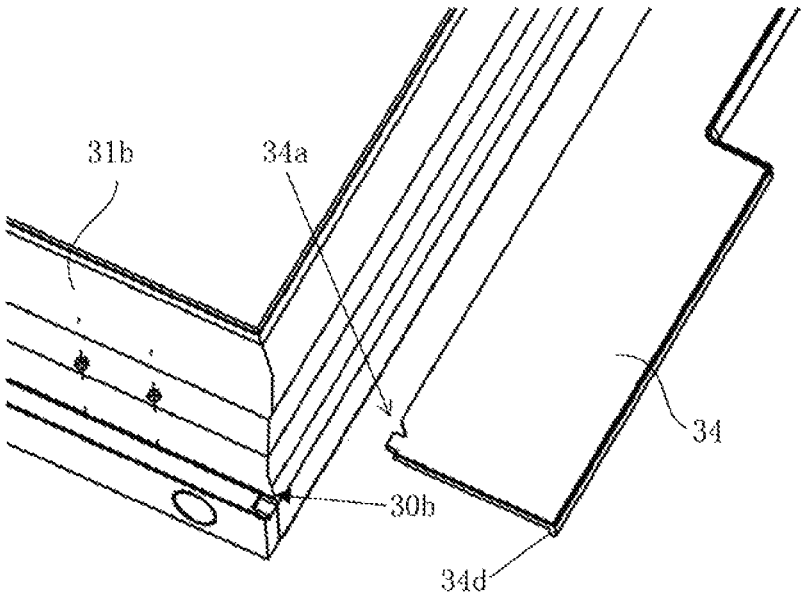
FIG. 5 is a partial exploded enlarged diagram of an outer door on one side of a protecting plate in a refrigerator according to an embodiment of the present invention.

As shown in FIG. 4 and FIG. 5, one side of the protecting plate 34 towards the doorframe 31*b* is provided with a positioning structure in cooperation with the doorframe 31*b*, and the positioning structure is configured to locate a position of the protecting plate 34 relative to the doorframe 31*b* in a length direction of the protecting plate 34. The positioning structure may be in multiple forms, for example, it may be a bolt configured to cooperate with a pin hole provided in the doorframe. In this embodiment, the positioning structure includes positioning slots 34*a* located at two ends of the protecting plate 34 in a length direction, and the positioning slots 34*a* are clamped with corners 30*b* located at ends of the doorframe 31*b* in the length direction.

During mounting, the first flange 34*c* is inserted into the corresponding recess 31*c* of the doorframe 31*b* first to fix a relative position between the protecting plate 34 and the doorframe 31*b*, and the positioning slots 34*a* as the positioning structure are clamped into the corners 30*b* of the doorframe 31*b*, then a cover of the front door panel 32 is provided on front surfaces of the doorframe 31*b* and the protecting plate 34, and the protecting plate 34 is adhered to the front door panel 32 to sandwich the fixing edge 34*b* between the doorframe 31*b* and the front door panel 32.

Referring to FIG. 2 and FIG. 3, along a width direction of the door, the free end A of the protecting plate 34 exceeds out of the cover portion 33. A shape of an exceeding part of the protecting plate 34 that exceeds out of the cover portion 33 may be set according to a requirement of industrial design.

In this embodiment, the free end A includes a second flange 34*d* bent backward. This is beneficial to beautifying a boundary curve of the outer door 30 and reducing visible gaps between the outer door 30 and the inner door 20.

A shape of a cross section of the second flange 34*d* may be arc, circular, linear and the like.

In this embodiment, the second flange 34*d* is in the shape of a sloping surface and slopes along a direction away from the heat-insulation portion 31. That is, an included angle between the second flange 34*d* and the cover portion 33 is an obtuse angle. In some other embodiments, the second flange 34*d* may be perpendicular to a plane of the cover portion 33.

In the foregoing embodiments, the heat-insulation portion 31 of the outer door 30 is formed by using the heat-insulation glass module and a frame thereof. In another embodiment, the heat-insulation portion of the outer door may be formed by using a heat-insulation door body filled with foamed heat-insulation materials, and the front door panel may be closely combined with heat-insulation materials in a foaming process of the heat-insulation door body to form an indivisible part of the heat-insulation door body, or the front door panel may be connected to a front side of the heat-insulation door body after the foaming process of the heat-insulation door body. In the front-and-rear direction, the cover portion exceeds out of the heat-insulation portion, so that projections of the cover portion and the heat-insulation portion do not overlap in the front-and-rear direction.

The present invention is disclosed as above, but the present invention is not limited thereto. Any person skilled in the art may make various variations and modifications without departing from the spirit and scope of the present invention. Therefore, the protection scope of the present invention should be subject to the scope defined by the claims.

The invention claimed is:

1. A refrigerator, comprising:

a case body having a storage compartment, an outer door rotatably disposed in front of said case body, and an inner door formed with an opening, and said outer door being located in front of said inner door for opening and closing said opening; and said outer door having a front door panel forming a facade of said outer door and having a heat-insulation portion, said front door panel having a cover portion projecting, along a length or width direction, beyond said heat-insulation portion and being configured to seal said opening; and said outer door further having a protecting plate connected to a rear surface of said cover portion and disposed to face said inner door, said protecting plate including a free end away from said heat-insulation portion, and said free end including a first flange being bent backward, said first flange extending out of an edge on a side of said cover portion away from said heat-insulation portion.

2. The refrigerator according to claim 1, wherein said heat-insulation portion comprises a doorframe, and said protecting plate is fixed to the doorframe.

3. The refrigerator according to claim 2, wherein one side of said protecting plate towards said doorframe is provided with a positioning structure in cooperation with said doorframe.

4. The refrigerator according to claim 3, wherein said positioning structure comprises positioning slots located at two ends of said protecting plate in a length direction, and said positioning slots are clamped with corners located at ends of said doorframe in the length direction.

5. The refrigerator according to claim 2, wherein said protecting plate comprises a fixing edge sandwiched between said front door panel and said doorframe.

6. The refrigerator according to claim 2, wherein said protecting plate comprises a second flange that extends towards a back of said door, and a surface of said doorframe towards a front of said door is provided with a recess for accommodating said second flange.

7. The refrigerator according to claim 1, wherein said first flange has a shape of a sloping surface and slopes along a direction away from said heat-insulation portion.

8. The refrigerator according to claim 1, wherein said protecting plate extends from one end to another end of said cover portion along a length direction of said cover portion.

9. The refrigerator according to claim 1, wherein said protecting plate completely covers the rear surface of said cover portion.

10. The refrigerator according to claim 1, wherein said door comprises a handle portion that protrudes forward and that is located at the back of said cover portion, and said protecting plate is located between said cover portion and said handle portion.

11. The refrigerator according to claim 10, wherein said handle portion and said protecting plate are disposed to form a gap therebetween in a front-and-rear direction.

12. The refrigerator according to claim 1, wherein said heat-insulation portion further comprises a heat-insulation glass module and a doorframe disposed around said heat-insulation glass module, and said front door panel is connected to a front side of said doorframe.

13. The refrigerator according to claim 12, wherein said doorframe comprises a plurality of borders that extend along the length direction and the width direction, and said borders are extruded members.

14. A refrigerator, comprising:

a case body having a storage compartment, an outer door rotatably disposed in front of said case body, and an inner door formed with an opening, and said outer door being located in front of said inner door for opening and closing said opening; and said outer door having a front door panel forming a facade of said outer door and having a heat-insulation portion, said front door panel having a cover portion projecting, along a length or width direction, beyond said heat-insulation portion and being configured to seal said opening; and said outer door further having a protecting plate connected to a rear surface of said cover portion and disposed to face said inner door, said protecting plate including a free end away from said heat-insulation portion, and said free end projecting out of a side of said cover portion away from said heat-insulation portion.

* * * * *